US006150768A

United States Patent [19]

Nilssen

[11] Patent Number: 6,150,768

[45] Date of Patent: Nov. 21, 2000

[54] BALLAST WITH ACTIVE POWER FACTOR CORRECTION

[76] Inventor: Ole K. Nilssen, Caesar Dr., Barrington, Ill. 60010

[21] Appl. No.: 08/292,928

[22] Filed: Aug. 18, 1994

Related U.S. Application Data

[63] Continuation of application No. 07/912,261, Jul. 13, 1992, abandoned, and a continuation-in-part of application No. 07/901,989, Jun. 22, 1992, Pat. No. 5,469,028.

[51] Int. Cl.[7] ..... H05B 37/02

[52] U.S. Cl. ..... 315/209 R; 315/219; 315/223; 315/283; 315/DIG. 7; 315/307

[58] Field of Search ..... 315/209 R, 219, 315/223, 283, DIG. 7, 307

[56] References Cited

U.S. PATENT DOCUMENTS

| | | | |
|---|---|---|---|
| 4,560,908 | 12/1985 | Stupp et al. | 315/DIG. 7 X |
| 5,032,767 | 7/1991 | Erhardt et al. | 315/DIG. 7 X |

*Primary Examiner*—Frank G. Font
*Assistant Examiner*—Reginald A. Ratliff

[57] ABSTRACT

An electronic ballast is powered from a constant-magnitude DC supply voltage and provides a high-magnitude high-frequency voltage at a ballast output across which are connected two lamp-ballast series-combinations, each consisting of an instant-start fluorescent lamp series-connected with a ballasting capacitor. An auxiliary capacitor is connected in series with the ballast output, thereby having the total ballast output current flowing through it and causing an auxiliary high-frequency voltage to develop across its terminals. The constant-magnitude DC supply voltage is provided via a series-combination of a power-line-connected rectifier delivering an unfiltered full-wave-rectified power line voltage across a pair of rectifier DC terminals and an auxiliary DC power supply delivering an auxiliary DC voltage across a pair of auxiliary DC terminals from which, under open circuit condition, is available a DC voltage of magnitude equal to the peak magnitude of the full-wave-rectified power line voltage. Under short circuit condition, the absolute magnitude of the auxiliary DC current delivered from the auxiliary DC terminals is equal to the peak absolute magnitude of the sinusoidal current intended to be drawn from the power line under normal ballast operation. Via a transformer and rectifiers, the auxiliary DC voltage and current are derived from the auxiliary high-frequency voltage. As an overall result, the current drawn from the power line is in fact nearly sinusoidal.

32 Claims, 2 Drawing Sheets

BALLAST WITH ACTIVE POWER FACTOR CORRECTION

RELATED APPLICATION

This application is a continuation of Ser. No. 07/912,261 filed Jul. 13, 1992, now abandoned and a Continuation-in-Part of Ser. No. 07/901,989 filed Jun. 22, 1992, now U.S. Pat. No. 5,469,028, issued Nov. 21, 1995.

BACKGROUND OF THE INVENTION

1. Field of the Invention

This invention relates to power-factor-corrected electronic ballasts.

2. Description of Prior Art

For a description of pertinent prior art, reference is made to the following U.S. Pat. No. 3,263,122 to Genuit; U.S. Pat. No. 3,320,510 to Locklair; U.S. Pat. No. 3,996,493 to Davenport et el.; U.S. Pat. No. 4,100,476 to Ghiringhelli; U.S. Pat. No. 4,262,327 to Kovacik et al.; U.S. Pat. No. 4,277,726 to Burke; U.S. Pat. No. 4,370,600 to Zansky; U.S. Pat. No. 4,634,932 to Nilssen; U.S. Pat. No. 4,857,806 to Nilssen; and U.S. Pat. No. 4,952,849 to Fellows et al.

SUMMARY OF THE INVENTION

1. Objects of the Invention

A main object of the present invention is that of providing a cost-effective ballasting means for gas discharge lamps.

This as well as other objects, features and advantages of the present invention will become apparent from the following description and claims.

2. Brief Description of the Invention

A so-called parallel-resonant electronic ballast is powered from a constant-magnitude DC supply voltage and provides a high-magnitude high-frequency voltage at a ballast output. Across the ballast output are connected two lamp-ballast series-combinations; each series-combination consisting of an instant-start fluorescent lamp series-connected with a ballasting capacitor.

An auxiliary capacitor is connected in series with the ballast output, thereby having the total ballast output current flowing through it and causing an auxiliary high-frequency voltage to develop across its terminals.

The constant-magnitude DC supply voltage is provided via a series-combination of: (i) a power-line-connected rectifier delivering an unfiltered full-wave-rectified power line voltage across a pair of rectifier DC terminals; and (ii) an auxiliary DC power supply delivering an auxiliary DC voltage across a pair of auxiliary DC terminals from which, under open circuit condition, is available a DC voltage of magnitude equal to the peak magnitude of the full-wave-rectified power line voltage.

Under short circuit condition, the absolute magnitude of the auxiliary DC current delivered from the auxiliary DC terminals is equal to the peak absolute magnitude of the sinusoidal current intended to be drawn from the power line under normal ballast operation.

By way of a transformer and rectifiers, the auxiliary DC voltage and current are derived from the auxiliary high-frequency voltage across the terminals of the auxiliary capacitor. The amount of power delivered via the auxiliary DC power supply is only about 25% of the total power drawn from the power line; which is to say, only about 25% of the power drawn by the lamps.

As an overall result, the current drawn from the power line is nearly sinusoidal.

Stated differently, the constant-magnitude DC current drawn by the ballast circuit from its constant-magnitude DC supply voltage is sustained by drawing a power line current from the power line; which power line current is forced to have a sinusoidal waveshape by the particular characteristics of the auxiliary DC power supply; which particular characteristics are: (i) providing a DC voltage having an open circuit absolute magnitude equal to the absolute peak magnitude of the power line voltage; and (ii) providing a DC current of short circuit absolute magnitude equal to the absolute peak magnitude of the (desired) power line current.

DESCRIPTION OF THE PRESENTLY PREFERRED EMBODIMENT

Details of Construction

Figure 1:
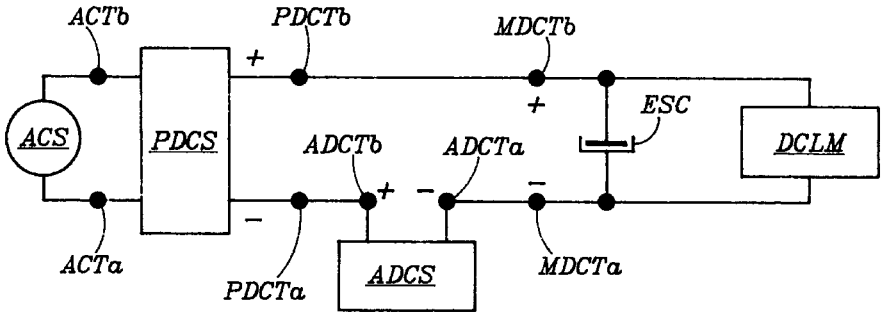
FIG. 1 is a schematic block diagram illustrating a basic concept underlying the present invention.

FIG. 1 is a block diagram illustrating a basic concept underlying the present invention.

In FIG. 1, a primary DC source PDCS has a pair of AC input terminals ACTa and ACTb connected with an AC source ACS, which is operative to provide between AC input terminals ACTa and ACTb an AC power line voltage such as that provided from an ordinary electric utility power line. Primary DC source PDCS provides between a pair of primary DC terminals PDCTa and PDCTb a primary DC voltage having an instantaneous absolute magnitude equal to that of the power line voltage.

An auxiliary DC source ADCS has a pair of auxiliary DC source terminals ADCTa and ADCTb across which is provided an auxiliary DC voltage having, under open circuit condition, a constant absolute magnitude equal to the peak absolute magnitude of the power line voltage.

Primary DC source PDCS is series-connected with auxiliary DC source ADCS in such manner that the positive terminal ADCTb of auxiliary DC source ADCS is connected with the negative terminal PDCTa of primary DC source PDCS. The resulting series-combination is then connected between a pair of main DC terminals MDCTa and MDCTb, such that negative terminal ADCTa is connected with negative main DC terminal MDCTa and positive terminal PDCTb is connected with positive main DC terminal MDCTb. An energy-storing capacitor ESC as well as a DC load means DCLM are each connected across main DC terminals MDCTa and MDCTb.

Figure 2:
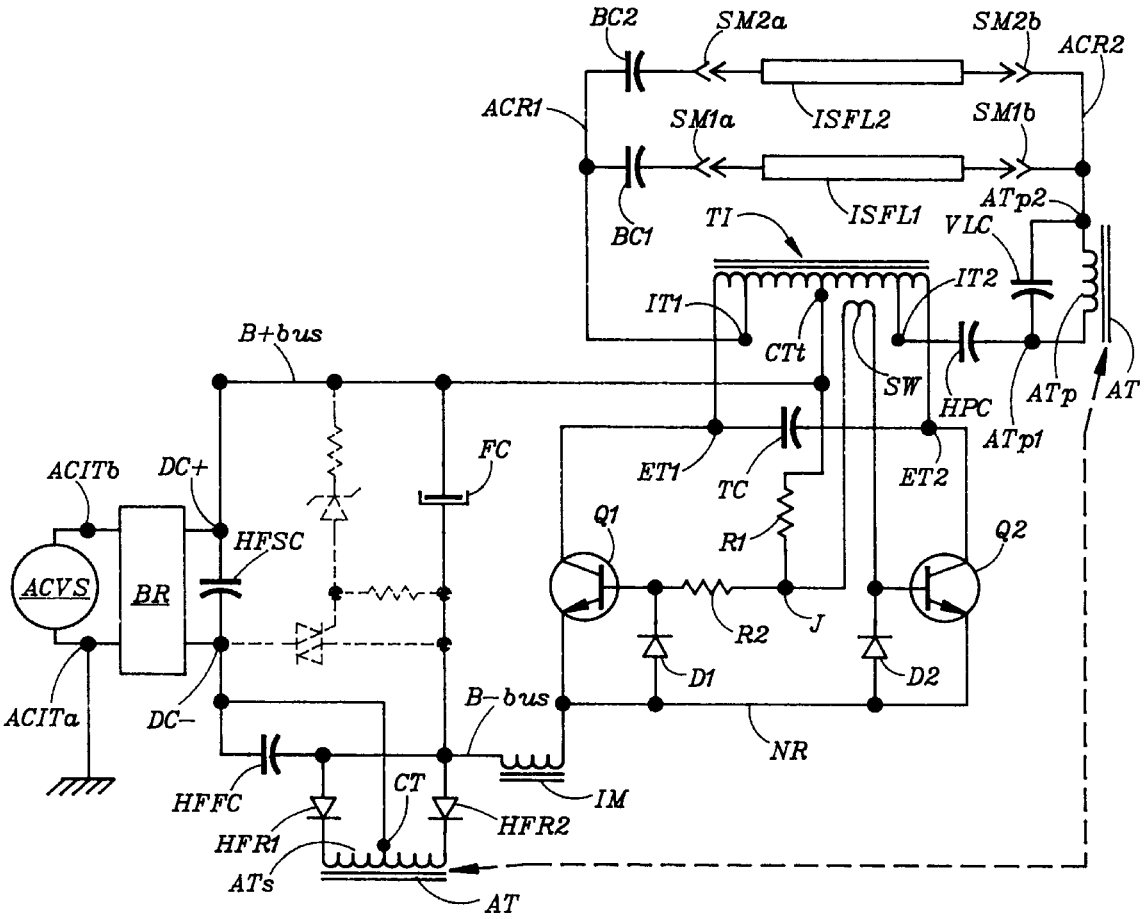
FIG. 2 is a schematic circuit diagram of the presently preferred embodiment of the invention.

FIG. 2 is a schematic circuit diagram illustrating the presently preferred embodiment of the invention.

In FIG. 2, an AC voltage source ACVS provides AC power line voltage across AC input terminals ACITa and ACITb of bridge rectifier BR, whose DC output is provided between a DC− terminal and a DC+ terminal. A high-frequency shunting capacitor HFSC is connected between the DC− and the DC+ terminals.

The DC+ terminal is connected with a B+ bus; the DC− terminal is connected with the center-tap CT of secondary winding ATs of an auxiliary transformer AT.

A first terminal of secondary winding ATs is connected with the cathode of a first high-frequency rectifier HFR1; a second terminal of secondary winding ATs is connected with the cathode of a second high-frequency rectifier HFR2. The anodes of rectifiers HFR1 and HFR2 are each connected with a B− bus. A filter capacitor FC is connected between the B+ bus and the B− bus. A high-frequency filter capacitor HFFC is connected between the DC− terminal and the B− bus. An inductor means IM is connected between the B− bus and a negative rail NR.

A tank inductor T1 has a center terminal CTt, a first end terminal ET1, a second end terminal ET2, a first intermediary terminal IT1, and a second intermediary terminal IT2.

Center terminal CTt is connected with the B+ bus; end terminal ET1 is connected with the collector of a first transistor Q1, whose emitter is connected with negative rail NR; end terminal ET2 is connected with the collector of a second transistor Q2, whose emitter is connected with negative rail NR; intermediary terminal IT1 is connected with a first AC rail ACR1; and intermediary terminal IT2 is connected, by way of a high-pass capacitor HPC, with a first terminal ATp1 of primary winding ATp of auxiliary transformer AT. A tank capacitor TC is connected between end terminals ET1 and ET2.

An voltage-limiting capacitor VLC is connected between first terminal ATp1 and a second terminal ATp2 of primary winding ATp of auxiliary transformer AT. Second terminal ATp2 is connected with a second AC rail ACR2.

A first ballasting capacitor BC1 is connected between first AC rail ACR1 and a socket means SM1*a;* a first instant-start fluorescent lamp ISFL1 is connected between socket means SM1*a* and a socket means SM1*b;* which, in turn, is connected with second AC rail ACR2.

Similarly, a second ballasting capacitor BC2 is connected between first AC rail ACR1 and a socket means SM2*a;* a second instant-start fluorescent lamp ISFL2 is connected between socket means SM2*a* and a socket means SM2*b;* which, in turn, is connected with second AC rail ACR2.

Tank inductor TI has a secondary winding SW connected between the base of transistor Q2 and a junction J. A resistor Rl is conected between the B+ bus and junction J; and a resistor R2 is connected between junction J and the base of transistor Q1. A first diode D1 is connected with its cathode to the base of transistor Q1 and with its anode to negative rail NR; a second diode D2 is connected with its cathode to the base of transistor Q2 and with its anode to negative rail NR.

Details of Operation

Figure 3:
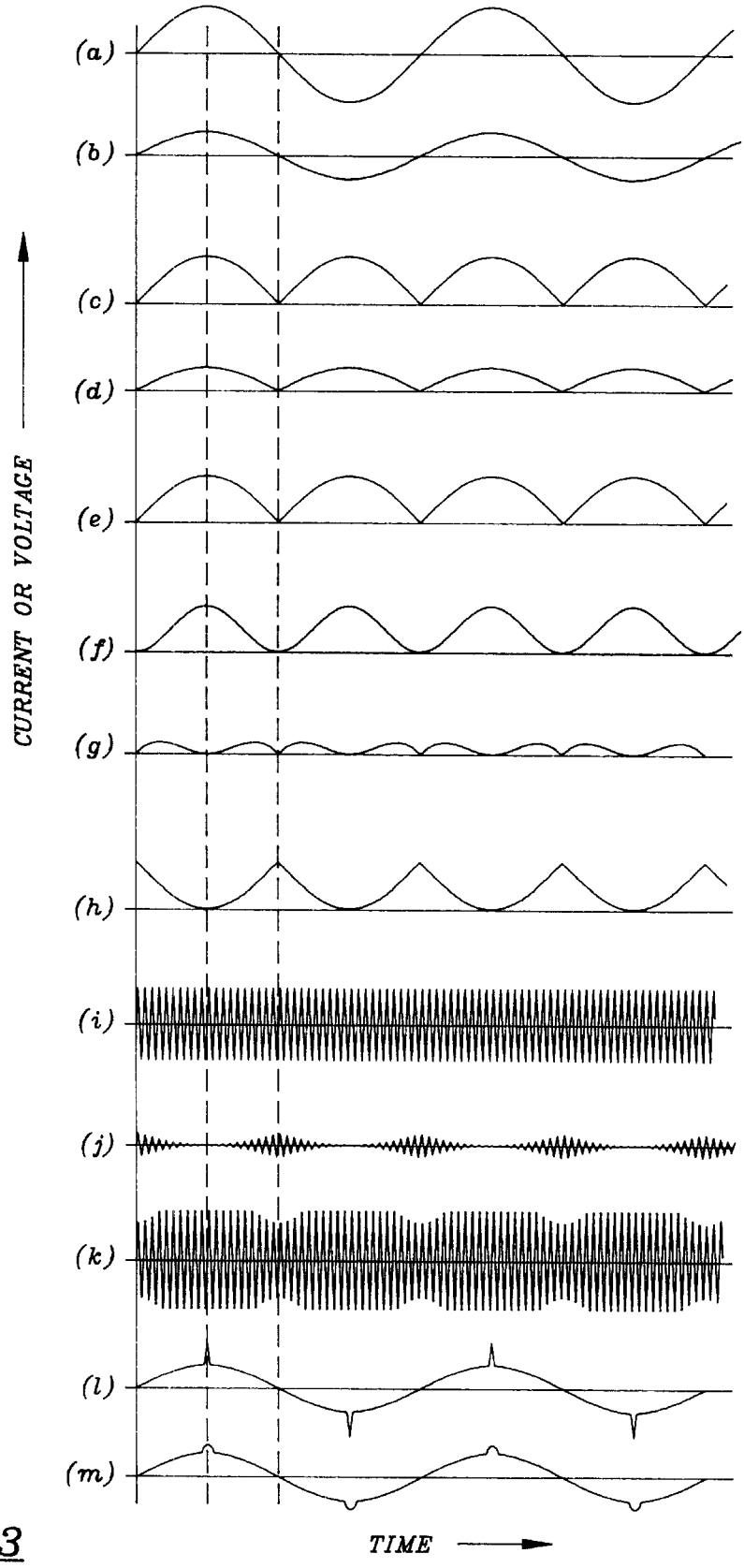
FIG. 3 illustrates various voltage and current waveforms associated with the operation of the presently preferred embodiment of the invention.

The operation of the circuit arrangement illustrated by the block diagram of FIG. 1 as well as of the circuit arrangement illustrated by the circuit diagram of FIG. 2 may best be understood with reference to the various voltage and current waveforms of FIG. 3.

In FIG. 3:

Waveform (a) illustrates the 60 Hz sinusoidal AC voltage provided by AC source ACS of FIG. 1 (or by AC voltage source ACVS of FIG. 2);

Waveform (b) illustrates the desired waveshape of the current drawn from source ACS (or from source ACVS);

Waveform (c) illustrates the DC voltage provided between terminals PDCTa and PDCTb of FIG. 1 (or between terminals DC− and DC+ of FIG. 2)—with the constant-magnitude DC voltage present between main terminals MDCTa/MDCTb of FIG. 1 (or between the B− bus and the B+ bus of FIG. 2) indicated by the dashed line referred-to as "DC Supply Voltage";

Waveform (d) illustrates the desired waveshape of the current drawn from terminals PDCTa/PDCTb of FIG. 1 (or from terminals DC−/DC+ of FIG. 2);

Waveform (e) illustrates the instantaneous magnitude of the power delivered to main DC terminals MDCTa/MDCTb of FIG. 1 (or to the B− bus and the B+ bus of FIG. 2) as a result of receiving the current depicted by Waveform (d);

Waveform (f) illustrates the instantaneous magnitude of the power delivered from prime DC source PDCS (i.e., from AC source ACS) of FIG. 1 (or from bridge rectifier BR—i.e., from AC voltage source ACVS—of FIG. 2) as a result of Waveforms (c) and (d);

Waveform (g) illustrates the instantaneous difference between the power delivered to main DC terminals MDCTa/MDCTb and the power delivered from source ACS (or from source ACVS); which instantaneous difference is equivalent to the instantaneous magnitude of the power delivered from auxiliary DC source ADCS of FIG. 1 (or from the rectified/filtered output of auxiliary transformer AT of FIG. 2);

Waveform (h) illustrates the instantaneous difference between the constant-magnitude DC Supply Voltage {as illustrated by the dashed line indicated on top of Waveform (c)} and the DC voltage illustrated by Waveform (c); which instantaneous difference represents the DC voltage imposed (and therefore actually present) across auxiliary DC terminals ADCTa/ADCTb of FIG. 1 (i.e., between the B− bus and the DC− terminal of FIG. 2);

Waveform (i) shows the envelope of the amplitude of the substantially unmodulated high-frequency voltage existing across tank capacitor TC;

Waveform (j) shows the envelope of the modulated amplitude of the high-frequency voltage across primary winding ATp of auxiliary transformer AT;

Waveform (k) shows the envelope of the high-frequency current flowing through one of instant-start fluorescent lamps ISFL1/ISFL2;

Waveform (1) shows the waveshape of the current drawn from AC source ACS under a condition where the absolute magnitude of the short-circuit current delivered from terminals ADCSa/ADCSb is lower than the absolute peak magnitude of the current that would have been drawn from AC source ACS had this latter current been drawn with perfect power factor; and Waveform (m) shows the waveshape of the current drawn from AC source ACS under the same condition as for Waveform (1), except for having inserted a current-limiting resistor of relatively low resistance value in series with AC source ACS.

With reference to the waveforms of FIG. 3, the operation of the circuit arrangements illustrated by FIGS. 1 and 2 may be explained as follows.

In the circuit arrangement of FIG. 1, the DC voltage provided across primary DC output terminals PDCra/PDCTb {which DC voltage is depicted by Waveform (c)} results from non-filtered full-wave-rectification of the sinusoidal AC voltage provided from AC source ACS (which could be an ordinary electric utility power line) and is substantially independent of the magnitude of any DC current which might flow from or between terminals PDCTa/PDCTb. With the magnitude of the DC voltage present between main DC terminals MDCTa/MDCTb being constant and equal to the peak magnitude of the DC voltage provided between primary DC terminals PDCTa/PDCTb, the voltage resulting between auxiliary DC terminals ADCTa/ADCTb will have an instantaneous magnitude as depicted by Waveform (h).

With filter capacitor FC being of very large capacitance (i.e., capacitance large enough to provide for nearly perfect filtering), the DC voltage depicted by Waveform (h) represents a stiff DC voltage source, which is to say: a DC voltage source of substantially negligible internal impedance. Thus, the stiff DC voltage provided by this stiff DC voltage source is imposed across auxiliary DC terminals ADCTa/ADCTb.

Auxiliary DC source ADCS, on the other hand, is not a stiff DC voltage source; which is to say that auxiliary DC source ADCS has a significant internal impedance. More particularly, auxiliary DC source ADCS should provide: (i) an open-circuit DC voltage of magnitude equal to that of the peak magnitude of the DC voltage depicted by Waveform (c); and (ii) a short-circuit DC current of magnitude equal to the peak magnitude of the DC current depicted by Waveform (d).

Thus, auxiliary DC source ADCS has an internal impedance defined by the ratio between the peak magnitude of the DC voltage provided by primary DC source PDCS and the peak magnitude of the DC current provided by primary DC source PDCS; which, of course, is equivalent to saying that the internal impedance of of auxiliary DC source ADCS is equal to the ratio between the RMS magnitude of the AC voltage provided by AC source ACS and the RMS magnitude of the AC current drawn from AC source ACS.

In other words, to provide for the desired (sinusoidal) line current waveform, the internal impedance of auxiliary DC source ADCS must be substantially constant (i.e., linear) and it must be equal (in absolute magnitude) to the impedance reflected at the AC input terminals of primary DC source PDCS. Thus, for instance, for perfect power factor and with 120 Volt AC sinusoidal supply voltage, when operating at a power level of (say) 60 Watt, the AC current drawn from the power line should be in-phase and sinusoidal, with RMS magnitude of 0.5 Ampere; which indicates that the AC power input terminals of primary DC source PDCS represent a resistive impedance of 240 Ohm; which, in turn, indicates that the internal impedance of auxiliary DC source ADCS should be of (absolute) impedance equal to 240 Ohm.

As viewed from a different aspect angle, whatever impedance is placed across primary DC terminals PDCTa/PDCTb is reflected to AC terminals ACTa/ACTb of primary DC source PDCS. Thus, if that impedance were to be a linear impedance, such as resistor (e.g., 240 Ohm), a corresponding linear impedance (e.g., 240 Ohm) would be reflected to AC terminals ACTa/ACTb. Since, over the time span represented by a complete cycle of the AC voltage provided from AC source ACS, the effective impedance of energy-storing capacitor ESC is essentially zero, the net effective impedance placed across primary DC terminals PDCTa/PDCTb is in fact the impedance represented by auxiliary DC source ADCS.

As an overall bottom line result: current drawn from AC source ACS will be drawn with perfect power factor provided: (i) the absolute magnitude of the open-circuit DC voltage supplied from auxiliary DC source ADCS is about equal to the peak absolute magnitude of the AC voltage supplied by AC source ACS; and (ii) the absolute magnitude of the short-circuit DC current supplied from auxiliary DC source ADCS is about equal to the absolute peak magnitude of the current supplied by AC source ACS.

As the magnitude of the AC voltage provided by AC source ACS changes, for the circuit arrangement of FIG. 1 to continue to draw current from AC source ACS with perfect power factor, it is necessary that the magnitude of the open-circuit DC voltage provided from auxiliary DC source ADCS change accordingly. Also, it is similarly necessary for the magnitude of the short-circuit DC current delivered from auxiliary DC source ADCS change in accordance with the resulting change in the DC current drawn by DC load means DCLM. Thus, for instance, if DC load means DCLM were to be a linear resistive load, if the magnitude of the AC voltage supplied by AC source ACS were to increase, it be necessary—for perfect power factor to be maintained—for the magnitudes of the open-circuit DC voltage and short-circuit DC current from auxiliary DC source ADCS to increase correspondingly.

However, in many situations, DC load means DCLM may not be a linear resistive load. For instance, an ordinary inverter-type electronic ballast circuit would not represent a linear resistive load. Nevertheless, even if DC load means DCLM were to be non-linear—as long as the magnitude of the AC voltage supplied by AC source ACS does not change over an unreasonably wide range—near perfect power factor correction may still be attained.

The circuit arrangement of FIG. 2 illustrates a practical application of the invention represented by FIG. 1.

FIG. 2 includes a so-called parallel-resonant inverter-type ballast circuit; which ballast circuit is substantially ordinary except for the following features.

(1) The fluorescent lamps are powered directly from taps (IT1/IT2) on main tank inductor TI rather than—as usual—being powered by way of a separate (electrically isolated) secondary winding on the tank inductor. To mitigate electric shock hazard (i.e., to meet U.L. requirements), the lamps are powered from a pair of AC rails (i.e., ACR1/ACR2), each of which —with reference to ground—exhibits the same RMS magnitude with respect to high-frequency voltage.

(2) To mitigate electric shock hazard as might result from super-imposition of low-frequency (e.g., 60 Hz) AC voltage from AC voltage source ACVS onto the high-frequency (e.g., 30 kHz) AC voltage provided to the fluorescent lamps, a low-frequency blocking capacitor (i.e., high-pass capacitor HPC) is used for preventing such low-frequency AC voltage from having any significant effect at the ultimate ballast output terminals (i.e., socket means SM1*a*/SM1*b* and SM2*a*/SM2*b*).

(3) To provide for the circuit arrangement of FIG. 2 a source of power corresponding to that of auxiliary DC source ADCS of FIG. 1, voltage-limiting capacitor VLC is placed in series with one of the AC rails (e.g., ACR2), thereby having the total high-frequency ballast output current flowing through it. Thus, in combination with auxiliary transformer AT and rectifiers HFR1/HFR2, this capacitor constitutes the equivalent of auxiliary DC source ADCS of FIG. 1.

In other words:

(a) to mitigate electric shock hazard with respect to a person having to re-lamp a lighting fixture having an electronic ballasting means such as that of FIG. 2 and in which are mounted instant-start fluorescent lamps ISFL1 and ISFL2 in socket means S141*a*/SM1*b* and SM2*a*/SM2*b*, provisions are made by which: (i) the high-frequency voltage present at any given one of the lamp sockets is of magnitude insufficient to cause lamp ignition in a situation where a fluorescent lamp is connected between the electrode of that one given lamp socket and ground, even though that very same high-frequency voltage is of magnitude sufficient to cause the fluorescent lamp to remain lit if (in one way or another) it had been caused to ignite; and (ii) for a given fluorescent lamp (e.g., ISFL1), the high-frequency voltage provided at one of its lamp socket means (e.g., LSM1*a*) is of phase opposite to that of the high-frequency voltage provided at its other lamp socket means (i.e., LSM1*b*); and (b) to cause the complete ballast circuit arrangement of FIG. 2 to draw power-factor-corrected current from AC voltage source ACVS (i.e., from the power line), the high-frequency current supplied to the fluorescent lamps (which high-frequency current is in effect supplied from a current source as contrasted with being supplied from a voltage source) is used (by way of a capacitor of a given capacitance combined with a transformer and rectifier means) for providing the function of auxiliary DC source ADCS of FIG. 1.

Otherwise, the ballast circuit of FIG. 2 includes a so-called parallel-resonant self-oscillating inverter; which inverter self-oscillates by means of positive feedback provided from secondary winding SW. For further details in regard to the operation and characteristics of so-called parallel-resonant inverter-type ballasts, reference is made to U.S. Pat. No. 4,277,726 to Burke.

Additional Comments (aa) In FIG. 2, the circuitry located to the right of filter capacitor FC constitutes the DC load means. The circuitry located to the left of filter capacitor FC is defined as the DC source means. Thus, the DC source means includes (i) the main DC source represented by bridge rectifier BR as connected with AC voltage source ACVS, as series-connected with (ii) the auxiliary DC source represented by secondary winding ATs of transformer AT combined with rectifiers HFR1/HFR2.

(ab) Due to the basically non-linear characteristics of gas dicharge lamps, the DC load provided across filter capacitor FC (i.e., the DC load means) is non-linear: as the magnitude of the DC supply voltage across capacitor FC increases, the magnitude of the DC currcnt drawn by the DC load means remains substantially constant.

(ac) In an actual situation where AC voltage source ACVS is an ordinary 277 Volt/60 Hz electric utility power line, the AC voltage provided to AC input terminals ACITa/ACITb is indeed sinusoidal and as illustrated by Waveform (a) of FIG. 3. Also, a total power of 55.4 Watt is drawn from the 277 Volt/60 Hz power line; which indeed resulted in the AC current drawn by input terminals ACITa/ACITb to be sinusoidal and as illustrated by Waveform (b), but only after having provided for: (i) the absolute magnitude of the open-circuit DC voltage supplied from the auxiliary DC source (i.e., the rectifier-transformer combination represented by circuit elements HFR1/HFR2 and AT) to be equal to the peak absolute magnitude of the 277 Volt/60 Hz power line voltage (i.e., about 390 Volt); and (ii) the absolute magnitude of the short-circuit DC current supplied from the auxiliary DC source to be equal to the peak absolute magnitude of the sinusoidal AC current represented by Waveform (b)—which peak absolute magnitude, in correspondence with 54.4 Watt power draw, was 0.28 Ampere.

(ad) With reference to the situation described in section (ac) hereinabove, if—after having been adjusted to provide for the desired sinusoidal line current waveform at a power line voltage of 277 Volt—the magnitude of the power line voltage were to change, the waveform of the power line current would not necessarily remain sinusoidal.

In particular and by way of example, if the magnitude of the power line voltage were to be decreased from its nominal 277 Volt RMS magnitude by (say) 10% (i.e., to about 250 Volt RMS), the magnitude of the high-frequency lamp current would decrease about correpondingly; which, in turn, would decrease the absolute magnitude of the short-circuit DC current provided from the auxiliary DC source. However, due to the non-linearity of the DC load means (which results from the non-linearity of the gas discharge lamps), the magnitude of the DC current supplied from filter capacitor FC to the DC load means would not decrease correspondingly; which further leads to a situation where the waveshape of the AC line current drawn by bridge rectifier BR becomes non-sinusoidal. In fact, for a 10% reduction in the RMS magnitude of the AC power line voltage, the waveshape of the AC line current will change from the sinusoidal waveshape depicted by Waveform (b) to the non-sinusoidal waveshape depicted by Waveform (1) of FIG. 3.

More particularly still, in an actual ballast circuit built in accordance with the arrangement of FIG. 2, after having been adjusted (at a power line voltage of 277 Volt RBS) to draw AC line current exhibiting not more than about 10% Total Harmonic Distortion ("THD"), the AC line current drawn at a power line voltage of about 250 Volt RMS—having a waveshape like that of Waveform (1)—exhibited more than 30% THD.

(ae) With reference to the situation described in section (ad) hereinabove, by inserting a resistor of relatively low resistance value (e.g., 6.8 Ohm) in series with AC voltage source ACVS, the Total Harmonic Distortion of the line current resulting at 10% under-voltage was reduced from more than 30% {as indicated by Waveform (1)} to less than 20% {as indicated by Waveform (m)}. Yet, the insertion of this resistor had no effect on the THD of the line current drawn at nominal line voltage {as indicated by Waveform (b)}.

Also, it is important to recognize that the amount of added power dissipation resulting from inserting the indicated low-resistance-value (6.8 Ohm) resistor was only about 0.27 Watt.

(af) As indicated by Waveform (g) of FIG. 3, the amount of power that has to be delivered from the auxiliary DC source —which is equivalent to the amount of power that has to be delivered via auxiliary transformer AT—is quite small (about one fourth) compared with the amount of power delivered by the power line; which amount is indicated by Waveform (f) of FIG. 3.

In other words, the amount of power that must be fed back from the inverter's output (i.e., from terminals IT1 and IT2), is (on the average) only about 20% of the inverter's total output power.

(ag) As a consequence a "stealing" high-frequency power from the inverter's output for feedback in the form of DC power to the inverter's input, the magnitude of the lamp current will be modulated at a frequency equal to twice the frequency of the AC voltage provided from AC voltage source ACVS—as illustrated by Waveform (k) of FIG. 3.

Nevertheless, the resulting lamp current crest factor remains well under 1.7, which is considered the maximum permissible lamp current crest factor in accordance with current industry specifications.

(ah) With reference to section (ae) hereinabove, said resistor of relatively low resistance value may advantageously be a non-linear resistance means, For instance, in place of said resistor may be used a field effect transistor whose gate voltage is set so as to prevent the flow of current of magnitude in excess of a preset level. Better yet, the gate voltage of the field effect transistor may be modulated so as to provide for a time-varying limit on the maximum permissible flow of current.

(ai) It is noted that a voltage-limiting inductor may be used in place of voltage-limiting capacitor C. In fact, such a current-limiting inductor may be made an integral part of auxiliary transformer AT, such as by providing for an air gap in the magnetic material (ferrite) of this transformer.

(aj) If the ballast arrangement of FIG. 2 is set up for proper operation with two fluorescent lamps, and if one of the lamps were to be removed, the waveshape of the line current drawn from the power line would change, causing substantial increase in the relative (i.e., percentage) Total Harmonic Distortion of this line current. However, the absolute level of Total Harmonic Distortion in the line current would not be significantly affected.

(ak) In the circuit arrangement of FIG. 1, if a person were to directly touch one of the socket terminals in any of socket means SM1*a*/SM1*b* or SM2*a*/SM2*b*, while at the same time being in electrical connection with ground (which, in turn, is connected with the conductors of the power line) he would be apt to receive an electric shock of hazardous magnitude.

In other words, the socket electrodes of socket means SM1*a*/SM1*b* and SM2*a*/SM2*b* are capable of supplying a current of shock-hazardous magnitude to a ground-connected element.

However, since the magnitude of the voltage existing between any one of the socket electrodes and ground is too low to cause one of the fluorescent lamps to ignite, a situation exists whereby—if a person where to touch one of the socket electrodes by way of one of the fluorescent lamps (which might occur during a normal relamping process)—he would not be exposed to shock hazard even if he were to be in electrical connection with ground.

Thus, if a person (in electrical connection with ground) were to touch one of the socket electrodes by way of one of the fluorescent lamps, he would be protected by the lamp from being exposed to a hazardous electric shock. That is, the lamp would constitute an intervening impedance functional to protect against electric shock hazard.

(al) In order to ignite properly, instant-start fluorescent lamps ISF1/ISFL2 of FIG. 2 requires a source voltage of at least 500 Volt RMS magnitude. After the lamps are fully ignited, the lamp operating voltage is about 140 Volt RMS at an operating current of about 175 milli-Ampere at a frequency of 20–30 kHz.

(am) In FIG. 2, if a short-circuit were to be placed across the ballast's output terminals—such as might occur if the leads going from the ballast to socket means SM1*a*/SM1*b* and/or SM2*a*/SM2*b* were to be accidentally connected together—a situation would occur whereby the magnitude of the main DC supply voltage (i.e., the DC voltage present across energy-storing capacitor ESC) would keep on increasing, eventually to reach an absolute magnitude much higher than the peak absolute magnitude of the power line voltage, thereby to cause destruction of the ballast.

To prevent such a run-away situation from occurring, an electronic switch means (e.g., an SCR) may be placed across the DC terminals of the auxiliary DC source and caused to be switched ON in case the magnitude of the main DC supply voltage were to increase beyond a predetermined level.

As shown in phantom outline in FIG. 2, to provide for a run-away prevention means, a Triac is connected between the DC− terminal and the B− bus. The Triac's gate is connected to the B− bus via a first resistor and to the B+ bus via a Zener diode series-connected with a second resistor. In this run-away prevention means, the Triac receives current at its gate, and is therefore rendered conductive, whenever (and for as long as) the magnitude of the DC supply voltage (i.e., the DC voltage present across filter-capacitor FC) exceeds a certain level; which level is determined by the magnitude of the Zenering voltage of the Zener diode. Thus, if as a result of the DC power provided from the auxiliary DC source, the magnitude of th DC DC supply voltage were to increase past this level, the Triac would become conductive, thereby preventing the auxiliary DC source from providing further DC power until after the magnitude of the DC supply voltage were to decrease below this level.

(an) Instead of powering the auxiliary DC source from the ballast's output current, it may be powered more directly from the inverter's output. For instance, in FIG. 2, by moving the location of the auxiliary DC source from its position between the B− bus and the DC− terminal to a location between the DC+ terminal and the B+ bus, the auxiliary DC source it may be powered from a pair of auxiliary taps on tank inductor TI; the output current from which taps would then be fed through a current-limiting inductor means before being full-wave-rectified and applied between the DC+ terminal and the B+ bus. The position of the auxiliary taps and the degree of current-limiting would be chosen such as to provide for just the right open-circuit DC voltage and short-circuit DC current for a situation of having both lamps connected with the ballast's output; in which case the ballast would drawn a substantially sinusoidal current from the power line (i.e., near perfectly power-factor-corrected) and the magnitude of the main DC voltage would not be in a run-away situation.

However, with only one lamp connected, a run-away situation would occur except for the above-indicated Triac run-away prevention means. Of course, the action of the Triac run-away prevention means causes the waveshape of the line current to deviate from being sinusoidal, except for brief periods at a time. Thus, while the line current will be nearly perfectly sinusoidal under the normal condition of having the ballast power two lamps, it will be less than perfectly sinusoidal when the ballast powers only a single lamp.

(ao) In one particular implementation of the present invention, the electronic ballast for fluorescent lamps represented by the circuit arrangement of FIG. 2 exhibits a variety of different features and may be properly characterized in several different ways, such as:

(1) by being powered by the AC power line voltage from an ordinary electric utility power line, yet at the same time: (i) having an inverter powered from a DC supply voltage of absolute magnitude approximately equal to the peak absolute magnitude of the AC power line voltage; and (ii) drawing line current with no more than 10% Total Harmonic Distortion and with a power factor higher than 90%;

(2) by being powered by the AC power line voltage from an ordinary electric utility power line, yet at the same time: (i) having an inverter powered from a DC supply voltage of substantially constant magnitude; (ii) drawing line current with no more than 10% Total Harmonic Distortion; and (iii) using high-frequency power drawn from the inverter's output to supply a part (about 20%) of the DC power drawn by the inverter;

(3) by being powered by the AC power line voltage from an ordinary electric utility power line, yet at the same time: (i) having an inverter powered from a DC supply voltage of absolute magnitude approximately equal to the peak absolute magnitude of the AC power line voltage; and (ii) drawing line current whose Total Harmonic Distortion decreases with increasing RMS magnitude of the AC power line voltage;

(4) by being powered by the AC power line voltage from an ordinary electric utility power line, yet at the same time: (i) having an inverter powered from a DC supply voltage of absolute magnitude approximately equal to the peak absolute magnitude of the AC power line voltage; and (ii) drawing, from the AC power line, a line current whose waveshape changes substantially as a function of the RMS magnitude of the AC power line voltage;

(5) by including an inverter powered from a DC supply voltage of substantially constant magnitude, yet at the same time causing an amplitude-modulated current to flow through its associated fluorescent lamps;

(6) by including an inverter powered from a DC supply voltage of substantially constant magnitude; which DC supply voltage is provided by two series-connected DC sources; one of which DC sources supplies a DC voltage of absolute instantaneous magnitude about equal to that of the AC power line voltage on an ordinary electric utility power line;

(7) by being powered from the AC power line voltage on an ordinary electric utility power line, yet at the same time including a main DC source operative to provide to an inverter a DC supply voltage of substantially constant magnitude; the main DC source being supplied with DC current from two separate DC sources: a prime DC source drawing low-frequency power directly from the power line and an auxiliary DC source drawing high-frequency power from the inverter's output;

(8) by being powered from the AC power line voltage on an ordinary electric utility power line, yet at the same time including a main DC source operative to provide to an inverter a DC supply voltage of substantially constant magnitude; the main DC source being supplied with DC current from two separate series-connected DC sources: a prime DC source drawing low-frequency power directly from the power line and an auxiliary DC source drawing high-frequency power from the inverter's output;

(9) by being powered from the AC power line voltage on an ordinary electric utility power line, yet at the same time including: (i) an inverter being supplied with DC power from a main DC voltage of substantially constant magnitude; and (ii) an auxiliary DC source functional to provide across a pair of auxiliary DC terminals a DC voltage whose instantaneous absolute magnitude equals the difference between the instantaneous absolute magnitude of the main DC voltage and the instantaneous absolute magnitude of the AC power line voltage; the auxiliary DC source also being functional to supply a significant fraction of the DC power being supplied to the inverter;

(10) by being:

(a) connected with two power line conductors between which exists the AC power line voltage of an ordinary electric utility power line; and (b) functional: (i) to provide a high-magnitude high-frequency voltage between a pair of ballast output terminals; (ii) to cause a fluorescent lamp connected between the ballast output terminals to ignite and to be supplied with operating current; (iii) in the absence of an intervening impedance means, to permit current of shock-hazardous magnitude to flow between one of the ballast output terminals and one of the power line conductors; and (iv) to prevent ignition of that same fluorescent lamp if it be connected between said one of the ballast output terminals and said one of the power line conductors, such as to permit the fluorescent lamp to serve as said intervening impedance means;

(11) by drawing an AC power line current in response to the AC power line voltage provided from an ordinary electric utility power line, yet at the same time including: (i) an inverter being supplied with DC power from a main DC voltage of substantially constant magnitude; and (ii) an auxiliary DC source characterized by providing an open-circuit DC voltage of magnitude about equal to that of the main DC voltage and a short-circuit DC current of absolute magnitude about equal to the peak absolute magnitude of the AC power line current;

(12) by including an inverter supplied with a constant-magnitude DC voltage provided from two series-connected DC sources: (i) a primary DC source providing a primary DC voltage having an instantaneous absolute magnitude equal to that of the AC power line voltage of an ordinary electric utility power line; and (ii) an auxiliary DC source providing an auxiliary DC voltage across a pair of auxiliary DC terminals of absolute instantaneous magnitude equal to the difference between the peak absolute magnitude of the AC power line voltage and the absolute instantaneous magnitude of this AC power line voltage; the auxiliary DC source actually delivering DC power to the inverter;

(13) by: (i) being powered by the sinusoidal AC power line voltage of an ordinary electric utility power line; (ii) drawing from this power line a power line current having a waveshape that is sinusoidal in the sense of having no more than about 10% Total Harmonic Distortion while at the same time being substantially in phase with the AC power line voltage; and (iii) including an inverter powered from a DC voltage having an absolute magnitude substantially equal to the peak absolute magnitude of the AC power line voltage;

(14) by including an auxiliary DC source operative to supply auxiliary DC power by way of an auxiliary DC voltage of instantaneous absolute magnitude proportional to the difference between the instantaneous absolute magnitude of a sinewave and the a peak absolute magnitude of this sinewave;

(15) by exhibiting across a pair of auxiliary high-frequency terminals a high-frequency voltage having an amplitude envelope whose absolute magnitude is proportional to the difference between the absolute instantaneous magnitude of a low-frequency sinewave and the peak absolute magnitude of this sinewave;

(16) by being powered from the AC power line voltage of an ordinary electric utility power line and including an auxilary DC source supplying auxiliary DC power to a DC load means represented by a main DC supply voltage of substantially constant magnitude; the magnitude of the flow of auxiliary DC power being modulated at a frequency equal to four times the frequency of the AC power line voltage;

(17) by being powered from the AC power line voltage of an ordinary electric utility power line and including an auxilary DC source supplying auxiliary DC power to a DC load means represented by a main DC supply voltage of substantially constant magnitude; which auxiliary DC power is being supplied in the form of DC power pulses occurring at a rate equal to four times the frequency of the AC power line voltage;

(18) by being powered from the AC power line voltage of an ordinary electric utility power line and, at least in some circumstances, drawing from this power line a line current having a waveshape equal to the sum of a substantially sinusoidal waveshape and a sequence of pulses of alternating polarity and frequency equal to that of the AC power line voltage;

(19) by including a primary DC source and an auxiliary DC source, where the primary DC source and the auxiliary DC source each supplies DC power to the DC input of an inverter operative to provide high-frequency output; a first part of which high-frequency output is fed back to the auxiliary DC source to be converted into DC power; a second part of which high-frequency output may be used for powering one or more fluorescent lamps;

(20) with reference to sections (am) and (an) hereof, by including:

(a) a primary DC source and an auxiliary DC source; the primary DC source exhibiting across a pair of primary DC terminals a primary DC voltage of instantaneous absolute magnitude about equal to that of the AC power line voltage of an ordinary electric utility power line; the primary DC source and the auxiliary DC source each supplying DC power to the DC input terminals of an inverter circuit operative to provide high-frequency output; a first part of the high-frequency output being fed back to the auxiliary DC source to be converted into DC power; a second part of the high-frequency output being conditionally used for powering one or more fluorescent lamps; and (b) a protection means functional to prevent the magnitude of the DC voltage provided to the DC input of the inverter circuit from exceeding the peak magnitude of the primary DC voltage.

Yet Additional Comments (ba) The term "crest-factor" as used in instant specification applies to a waveform, and represents the ratio of the peak magnitude of that waveform and the RMS magnitude of that waveform. Thus, a sinusoidal waveform has a crest factro of 1.4. In a fluorescent lamp, the lamp current crest factor is the ratio between the peak magnitude of the lamp current and the RMS magnitude of the lamp current.

(bb) With reference to the circuit arrangement of FIG. 1, it is noted that primary DC source PDCS is a very stiff source (i.e. it exhibits an internal impedance of negligible magnitude) in that the magnitude of the DC voltage provided between its output terminals PDCTa and PDCTb is substantially unaffected by the magnitude of any current flowing therefrom. On the other hand, auxiliary DC source ADCS is not a very stiff source (i.e., it has an internal impedance of significant magnitude) in that the magnitude of the DC voltage provided between its output terminals ADCTa and ADCTb is substantially affected by the magnitude of any current flowing therefrom.

(bc) In the inverter circuit of FIG. 2, the two main switching transistors operate in a symmetrical manner. That is, although shifted in time (or phase) with respect to each other, each transistor conducts periodically for a brief period at a time, with the duration of each conduction period being about the same (e.g., 20 micro-seconds) for each transistor.

(bd) The high-frequency (i.e., 20–30 kHz) current flowing through each of fluorescent lamps ISFL1/ISFL2 has a substantially sinusoidal waveshape, but is amplitude-modulated at a relatively low frequency {i.e., a frequency twice that of the (60 Hz) power line voltage}. The amplitude-modulated high-frequency lamp current is illustrated by Waveform (k) in FIG. 3.

(be) With reference to the circuit arrangement of FIG. 1, it is noted that the DC output of auxiliary DC source ADSC is directly series-connected with the DC output of primary DC source PDCS. With primary DC source PDCS being a stiff voltage source, the function served by auxiliary DC source ADCS may be reasonably described as that of acting as an aid in "pumping" charge from primary DC source PDCS into energy-storing capacitor ESC, with the rate of charge being pumped (i.e., current) being directly determined by the effective internal DC impedance associated with the DC output of auxiliary DC source ADCS.

Since the magnitude of the DC current flowing from (or between) terminals PDCTa/PDCTb of primary DC source PDCS must be equal to the DC current flowing from (or between) terminals ADCTa/ADCTb of auxiliary DC source ADCS, at any given point in time, the amount of power delivered from each given one of the two DC sources is proportional to the magnitude of the DC voltage present across the DC terminals of that given DC source at that point in time.

(bf) With reference to the Triac (or SCR) run-away prevention means described in section (am) hereinbefore, it is noted that once the Triac starts conducting current at the beginning of a half-cycle of the AC voltage supplied from AC voltage source ACVS {see Waveform (a) of FIG. 3}, it will continue to conduct for the full duration of that half-cycle. Thus, even if the Triac's gate current were to be removed during the course of a given half-cycle (which results when the magnitude of the DC supply voltage decreases below the Zenering level of the Zener diode), the Triac would not cease conducting until after the completion of that particular half-cycle.

Thus, while the Triac may be triggered into conduction at any point during a half-cycle, it will only cease conducting at the end of a half-cycle.

In other words, in situations where the auxiliary DC source provides sufficient DC power to cause the magnitude of the DC supply voltage to gradually increase (i.e., run away), the run-away prevention means will cause the auxiliary DC source to be peridically shorted, thereby causing alternation between increasing magnitude and decreasing magnitude of the DC supply voltage—with this alternation occurring at a fundamental frequency lower than the frequency of the half-cycles of the AC voltage provided from AC voltage source ACVS.

As an overall result: (i) as long as the magnitude of the DC supply voltage is higher than the particular level at which it causes the Triac to become conductive—which level must, of course, be higher than the peak level of the full-wave-rectified AC voltage from ACVS—no current will be drawn from AC voltage source ACVS; whereas (ii) as long as the magnitude of the DC supply voltage is lower than said particular level, a substantially sinusoidal current will be drawn from AC voltage source ACVS.

Thus, as long as the auxiliary DC source supplies more DC power than is being absorbed (with the help of the primary DC source) by filter capacitor FC (and its attached DC load), the magnitude of the DC supply voltage will increase (i.e., tend to run away), thereby causing the Triac to become conductive, thereby cutting off the flow of DC power from the auxiliary DC source until the magnitude of the DC supply voltage decreases to the point where the Triac ceases to be conductive, etc.; which means that line current will be drawn from AC voltage source ACVS only intermittently, but essentially in the form of complete half-cycles of sinusoidally-shaped current. The more excess DC power being supplied by the auxiliary DC source to filter capacitor FC—as compared with the total amount of DC power being drawn from filter capacitor FC—the fewer the number of half-cycles during which a sinusoidally-shaped line current is drawn, and the larger the number of half-cycles during which no line current is drawn.

(bg) With reference to FIG. 2 and the description provided in connection therewith (as considered with the waveforms of FIG. 3) , as any person possessing ordinary skill in the art hereto pertinent would readily perceive:

(1) The assembly of parts (or circuitry, or subcircuit, etc.) connected between power line input terminals ACITa and ACITb (on the left hand side of FIG. 2) and the two DC output terminals represented by the B− bus and the B+ bus (on the right hand side of FIG. 2) functions to rectify and otherwise condition (i.e., modify or change) the AC power line voltage so as to provide between the B− bus and the B+ bus a DC voltage of substantially constant magnitude (which is about equal to or somewhat lower than the peak magnitude of the power line voltage) and to draw from the power line conductors an alternating current of substantially sinusoidal waveform. This assembly of parts may hereinafter be referred-to as a rectifier arrangement.

(2) The assembly of parts (or circuitry, etc.) connected between the two DC output terminals (i.e., between the B− bus and the B+ bus) and the ballast output terminals (i.e., terminal-pairs SM1*a*/SM1*b* and/or SM2*a*/SM2*b*) may hereinafter be referred-to as a circuit arrangement.

What is claimed is:

1. An arrangement for ballasting a gas discharge lamp, comprising:

a power line providing a substantially sinusoidal AC power line voltage at a pair of power line conductors; the power line conductors being electrically connected with earth ground;

a rectifier arrangement connected with the power line conductors and operative: (i) to draw therefrom a line current having a substantially sinusoidal waveform, a substantially sinusoidal waveform being defined as a waveform having not more than 10% total harmonic distortion; and (ii) to provide a first DC voltage across a first pair of DC terminals; and a circuit arrangement connected with the DC terminals and functional to provide a high-frequency ballast output voltage between a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current having crest-factor not higher than about 1.7; the circuit arrangement being characterized by including an inverter circuit powered from a second pair of DC terminals across which exists a second DC voltage having an absolute magnitude approximately equal to the peak absolute magnitude of the AC line voltage.

2. The arrangement of claim 1 wherein:

(a) the second DC voltage has: (i) an instantaneous magnitude; and (ii) an average magnitude defined as having been averaged over a duration equal to that of a complete cycle of the AC power line voltage; and (b) the instantaneous magnitude does not deviate more than plus/minus 10% from the average magnitude.

3. The arrangement of claim 1 wherein the circuit arrangement is further characterized by including an auxiliary DC source connected in circuit with the ballast output terminals and operative to supply DC power to the second pair of DC terminals.

4. The arrangement of claim 3 wherein: (i) the auxiliary DC source has a pair of auxiliary DC terminals across which exists an auxiliary DC voltage; and (ii) the instantaneous absolute magnitude of the auxiliary DC voltage is approximately equal to the difference between the peak absolute magnitude of the AC power line voltage and the instantaneous absolute magnitude of the AC power line voltage.

5. The arrangement of claim 1 wherein a potentially shock-hazardous voltage exists between one'of the ballast output terminals and earth ground; the potentially shock-hazardous voltage being of magnitude insufficient to ignite said gas discharge lamp; thereby providing for a situation characterized as follows:

(i) if a person were to connect with one of the ballast output terminals, while at the same time being electrically connected with earth ground, he would be subject to a hazardous electric shock; while (ii) if that same person were to connect with one of the ballast output terminals by way of said gas discharge lamp, even if he were to be electrically connected with earth ground, he would not be subject to a hazardous electric shock.

6. The arrangement of claim 1 wherein: (i) the instantaneous absolute magnitude of the first DC voltage is substantially equal to that of the AC power line voltages.

7. The arrangement of claim 1 wherein: (1) the second DC voltage is of substantially constant magnitude; and (ii) the high-frequency lamp current is characterized by being amplitude-modulated at a frequency twice that of the AC power line voltage.

8. An arrangement for ballasting a gas discharge lamp, comprising:

a power line providing a substantially sinusoidal AC power line voltage at a pair of power line conductors; the power line conductors being electrically connected with earth ground;

a rectifier arrangement connected with the power line conductors and operative: (i) to draw therefrom a line current; and (ii) to provide a first DC voltage across a first pair of DC terminals; the instantaneous absolute magnitude of the first DC voltage being approximately equal to that of the AC power line voltage; and a circuit arrangement connected with the DC terminals and functional to provide a high-frequency ballast output voltage between a pair of ballast output terminals; the ballast output terminals being operable to connect with a gas discharge lamp; the high-frequency ballast output voltage being of magnitude sufficient to ignite such a gas discharge lamp and to supply it with high-frequency lamp current; the circuit arrangement being characterized by including:

(i) an inverter circuit provided with DC power from a second pair of DC terminals across which exists a second DC voltage having an absolute magnitude about equal to the peak absolute magnitude of the AC power line voltage; and (ii) an auxiliary DC source providing DC power from a pair of auxiliary DC terminals across which exists an auxiliary DC voltage having an absolute instantaneous magnitude equal to the difference between the absolute instantaneous magnitude of the second DC voltage and the absolute instantaneous magnitude of the first DC voltage; the pair of auxiliary DC terminals being connected with the first and the second pair of DC terminals.

9. The arrangement of claim 8 wherein part of the DC power provided to the inverter circuit is provided by the auxiliary DC source.

10. The arrangement of claim 9 wherein the auxiliary DC source is connected in circuit with the ballast output terminals and is operative: (i) to draw high-frequency power therefrom; and (ii) to convert this high-frequency power to DC power, at least part of which is provided to the inverter circuit.

11. An arrangement for ballasting a gas discharge lamp, comprising:

a power line providing a substantially sinusoidal AC power line voltage at a pair of power line conductors; the power line conductors being electrically connected with earth ground;

a rectifier arrangement connected with the power line conductors and operative: (i) to draw from the power line conductors a line current having a waveform composed of a substantially sinusoidal wave of frequency equal to that of the AC power line voltage, to which is added, at least under certain circumstances, relatively narrow pulses of alternating polarity and with frequency equal to that of the AC power line voltage; and (ii) to provide across a first pair of DC terminals a first DC voltage; and a circuit arrangement connected with the DC terminals and functional to provide a high-frequency ballast output voltage between a pair of ballast output terminals; the ballast output terminals being operable to connect with a gas discharge lamp; the high-frequency ballast output voltage being of magnitude sufficient to ignite such a gas discharge lamp and to supply it with high-frequency lamp current.

12. The arrangement of claim 11 wherein the narrow pulses are operative to cause the peak absolute magnitude of the line current to be at least 25% higher than what it be absent the narrow pulses.

13. The arrangement of claim 11 wherein each of the narrow pulses has a duration not longer than 25% of the duration of each half-cycle of the AC power line voltage.

14. An arrangement for ballasting a gas discharge lamp, comprising:

a power line providing a substantially sinusoidal AC power line voltage at a pair of power line conductors; the power line conductors being electrically connected with earth ground;

a rectifier arrangement connected with the power line conductors and operative: (i) to draw a line current therefrom; and (ii) to provide a first DC voltage across a first pair of DC terminals; the instantaneous absolute magnitude of the first DC voltage being substantially equal to that of the AC power line voltage; and a circuit arrangement connected with the first pair of DC terminals and functional to provide a high-frequency ballast output voltage between a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current; the circuit arrangement being characterized by including an inverter circuit supplied with DC power from a second pair of DC terminals across which exists a second DC voltage of substantially constant magnitude; at least part of the DC power supplied to the inverter circuit being derived from the ballast output terminals by way of an auxiliary DC source means connected in circuit with the ballast output terminals as well as with the second pair of DC terminals.

15. An arrangement for ballasting a gas discharge lamp, comprising:

a power line providing a substantially sinusoidal AC power line voltage at a pair of power line conductors; the power line conductors being electrically connected with earth ground;

a primary DC source connected with the power line conductors and operative: (i) to draw a line current therefrom; and (ii) to provide a primary DC voltage across a pair of primary DC terminals; the instantaneous absolute magnitude of the primary DC voltage being substantially equal to that of the AC power line voltage;

an inverter circuit being provided with main DC power from a pair of main DC terminals across which exists a main DC voltage of absolute magnitude about equal to that of the peak absolute magnitude of the AC power line voltage; the inverter circuit being functional to provide a high-frequency ballast output voltage between a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current; and an auxiliary DC source connected in circuit with the ballast output terminals and operative to provide an auxiliary DC voltage at a pair of auxiliary DC terminals; the auxiliary DC voltage having an instantaneous absolute magnitude about equal to the difference between the peak absolute magnitude of the AC power line voltage and the instantaneous absolute magnitude of the AC power line voltage; the auxiliary DC source being functional to deliver a substantial part of the DC power drawn by the inverter circuit from the main DC terminals;

the auxiliary DC source and the primary DC source being series-connected across the main DC terminals by way of their respective auxiliary and primary DC terminals.

16. An arrangement for ballasting a gas discharge lamp, comprising:

a primary DC source operative to provide primary DC power from a pair of primary DC terminals; a primary DC voltage existing between the primary DC terminals; the instantaneous absolute magnitude of the primary DC voltage being substantially equal to that of the AC power line voltage on an ordinary electric utility power line;

an auxiliary DC source operative to provide auxiliary DC power from a pair of auxiliary DC terminals; an auxiliary DC voltage existing between the auxiliary DC terminals; the instantaneous absolute magnitude of the auxiliary DC voltage being equal to the difference between the absolute magnitude of a main DC voltage and the instantaneous absolute magnitude of the AC power line voltage; the auxiliary source being connected in series with the primary DC source such as to form a combination DC source having a pair of combination DC terminals, thereby causing: (i) any current flowing from the combination DC terminals to flow between the primary DC terminals as well as between the auxiliary DC terminals; and (ii) any voltage existing between the combination DC terminals to have an absolute magnitude equal to that of the main DC voltage; and an inverter circuit connected with, and drawing main DC power from, the combination DC terminals; the inverter circuit being functional to provide a high-frequency ballast output voltage from a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current.

17. The arrangement of claim 16 wherein the auxiliary DC power supplied from the auxiliary DC source represents a significant part of the main DC power drawn from the combined DC terminals by the inverter circuit.

18. The arrangement of claim 16 wherein: (i) the primary DC source is connected in circuit with the power line conductors of an ordinary electric utility power line; and (ii) the auxiliary source is connected in circuit with the ballast output terminals.

19. The arrangement of claim 16 wherein the absolute magnitude of the main DC voltage is substantially equal to the peak absolute magnitude of the AC power line voltage.

20. The arrangement of claim 16 wherein the magnitude of the main DC voltage is substantially constant.

21. An arrangement for ballasting a gas discharge lamp, comprising:

a primary DC source operative to provide primary DC power from a pair of primary DC terminals; a primary DC voltage existing between the primary DC terminals; the instantaneous absolute magnitude of the primary DC voltage being substantially equal to that of the AC power line voltage on an ordinary electric utility power line;

an auxiliary DC source operative to provide auxiliary DC power from a pair of auxiliary DC terminals; an auxiliary DC voltage existing between the auxiliary DC terminals; the instantaneous magnitude of the auxiliary DC voltage being a function of the instantaneous magnitude of the DC current flowing from the auxiliary DC terminals, such that (i) when essentially no DC current is flowing therefrom, the magnitude of the auxiliary DC voltage is equal to a certain maximum DC voltage magnitude, and (ii) when DC current of a certain maximum DC current magnitude is flowing therefrom, the magnitude of the auxiliary DC voltage is essentially zero; the auxiliary DC source being connected in series with the primary DC source such as to form a combination DC source having a pair of combination DC terminals, thereby causing (i) any current flowing from the combination DC terminals to flow between the primary DC terminals as well as between the auxiliary DC terminals, and (ii) any voltage existing between the combination DC terminals, herein defined as a main DC voltage, to have an absolute magnitude equal to the sum of the absolute magnitude of the primary DC voltage and that of the auxiliary DC voltage; and an inverter circuit connected with, and drawing main DC power from, the combination DC terminals; the inverter circuit being functional (i) to cause the absolute magnitude of the main DC voltage to be substantially constant, and (ii) to provide a high-frequency ballast output voltage from a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current.

22. The arrangement of claim 21 wherein the absolute value of the certain maximum DC voltage magnitude is substantially equal to the peak absolute magnitude of the AC power line voltage.

23. The arrangement of claim 21 wherein: (i) the primary DC source is connected with the AC power line voltage of an ordinary electric utility power line and draws an AC line current therefrom; and (ii) the peak absolute magnitude of the AC line current is approximately equal to the absolute value of said certain maximum DC current magnitude.

24. The arrangement of claim 21 including prevention means (i) connected in circuit with the combination DC terminals, as well as with the auxiliary DC terminals, and (ii) operative to prevent the absolute magnitude of the main DC voltage from exceeding a predetermined absolute magnitude.

25. The arrangement of claim 24 wherein said predetermined absolute magnitude is higher than the peak absolute magnitude of the AC power line voltage.

26. The arrangement of claim 21 wherein the average DC power supplied from the auxiliary DC terminals is at least 10%, but not larger than about 30%, of the average power supplied from the primary DC terminals; average DC power being defined as DC power averaged over a complete cycle of the AC power line voltage.

27. An arrangement for ballasting a gas discharge lamp, comprising:

a power line providing a substantially sinusoidal AC power line voltage at a pair of power line conductors; the power line conductors being electrically connected with earth ground;

an inverter circuit having a pair of DC supply terminals and being functional to provide a high-frequency ballast output voltage from a pair of ballast output terminals; the ballast output terminals being operable to connect with a gas discharge lamp; the high-frequency ballast output voltage being of magnitude sufficient to ignite such a gas discharge lamp and to supply it with a high-frequency lamp current; and a voltage conditioning circuit connected between the power line conductors and the DC supply terminals; the voltage conditioning circuit being operative: (i) to draw line current from the power line conductors in an intermittent manner and in such a way that, whenever line current is in fact being drawn, it is of substantially sinusoidal waveshape; and (ii) to maintain a DC supply voltage of substantially constant magnitude across the DC supply terminals despite the intermittent manner in which line current is drawn.

28. The arrangement of claim 27 wherein the voltage conditioning circuit includes: (i) a primary DC source operative to provide a primary DC voltage across a pair of primary DC terminals; and (ii) an auxiliary DC source operative to provide an auxiliary DC voltage across a pair of auxiliary DC terminals;

the primary DC source being connected in series with the auxiliary DC source such as to form a combination DC source having a pair of combination DC terminals; which pair of combination DC terminals is connected across the DC supply terminals.

29. The arrangement of claim 28 including a shorting means connected in circuit with the DC supply terminals and the auxiliary DC terminals; the shorting means being responsive to the magnitude of the DC supply voltage and operative, in case the magnitude of the DC supply voltage were to exceed a predetermined level, to cause a short-circuit to be placed across the auxiliary DC terminals.

30. The arrangement of claim 27 wherein the line current is characterized by having total harmonic distortion not higher than about 20%.

31. The arrangement of claim 27 wherein the DC supply voltage is characterized by remaining within plus-minus 10% of a given reference level.

32. An arrangement for ballasting a gas discharge lamp, comprising:

a power line providing a substantially sinusoidal AC power line voltage at a pair of power line conductors; the power line conductors being electrically connected with earth ground;

a rectifier arrangement connected with the power line conductors and operative: (i) to draw therefrom a line current characterized by having a total harmonic distortion no higher than about 10%; and (ii) to provide a primary DC voltage between a pair of primary DC terminals;

an inverter circuit having a pair of main DC terminals across which exists a main DC voltage; the inverter circuit being operative to draw primary DC power from the primary DC terminals and to provide high-frequency ballast output power from a set of ballast output terminals; the ballast output terminals being operable to connect with and to power a gas discharge lamp with high-frequency lamp current of crest-factor no higher than 1.7; and an auxiliary DC source connected in circuit with the ballast output terminals as well as with the main DC terminals and the primary DC terminals; the auxiliary DC source being operative to draw high-frequency power from the ballast output terminals and to supply auxiliary DC power from a pair of auxiliary DC terminals to the main DC terminals; the auxiliary DC power supplied to the main DC terminals being, on average, substantially lower than the primary DC power drawn from the primary DC terminals.

* * * * *